US012228320B2

(12) United States Patent
Minami

(10) Patent No.: US 12,228,320 B2
(45) Date of Patent: Feb. 18, 2025

(54) AIR CONDITIONING APPARATUS

(71) Applicant: DAIKIN INDUSTRIES, LTD., Osaka (JP)

(72) Inventor: Junya Minami, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 240 days.

(21) Appl. No.: 17/736,608

(22) Filed: May 4, 2022

(65) Prior Publication Data

US 2022/0260293 A1 Aug. 18, 2022

Related U.S. Application Data

(63) Continuation of application No. PCT/JP2020/040900, filed on Oct. 30, 2020.

(30) Foreign Application Priority Data

Nov. 5, 2019 (JP) ..... 2019-201071

(51) Int. Cl.
*F25B 49/02* (2006.01)
*F25B 41/42* (2021.01)

(52) U.S. Cl.
CPC ..... *F25B 49/02* (2013.01); *F25B 41/42* (2021.01)

(58) Field of Classification Search
CPC ..... F25B 49/02; F25B 41/42
See application file for complete search history.

(56) References Cited

U.S. PATENT DOCUMENTS 3,536,869 A * 10/1970 Harold, Jr. ..... F42B 3/182 439/82
2019/0331377 A1* 10/2019 Matsuda ..... F25B 5/02

FOREIGN PATENT DOCUMENTS

CN 102424317 A 4/2012
EP 3 287 720 A1 2/2018
(Continued)

OTHER PUBLICATIONS

English translation of the International Preliminary Report on Patentability and Written Opinion of the International Searching Authority for International Application No. PCT/JP2020/040900, dated May 19. 2022.

(Continued)

*Primary Examiner* — Larry L Furdge
(74) *Attorney, Agent, or Firm* — Birch, Stewart, Kolasch & Birch, LLP

(57) ABSTRACT

An air conditioning apparatus with a refrigerant circuit includes a connecting portion to which a first electric wire and a second electric wire are connected. The first and second electric wires are connected to corresponding first and second devices of a plurality of safety devices. The plurality of safety devices includes at least two types of a refrigerant detector, an alarm device, an isolation valve, and a ventilation device. A circuit configuration portion forms an interlock circuit with the first electric wire and the second electric wire connected to the connecting portion. A first member enables formation of a first circuit including at least part of the circuit configuration portion and not including both the first electric wire and the second electric wire. A controller prohibits an operation of the air conditioning apparatus when no current flows through either the interlock circuit or the first circuit.

6 Claims, 8 Drawing Sheets

(56) References Cited

FOREIGN PATENT DOCUMENTS

| | | | | |
|---|---|---|---|---|
| EP | 3434997 | A2 * | 1/2019 | ..... F24F 11/36 |
| JP | 55-174647 | U | 12/1980 | |
| JP | 59-113931 | U | 1/1984 | |
| JP | 2001-336694 | A | 12/2001 | |
| JP | 2019-27663 | A | 2/2019 | |
| JP | 2019-52785 | A | 4/2019 | |
| JP | 2019-60517 | A | 4/2019 | |

OTHER PUBLICATIONS

Extended European Search Report for European Application No. 20884741.8, dated Nov. 18, 2022.
Standard of the Japan Refrigeration and Air Conditioning Industry Association, "Requirements of refrigerant leak detector and alarm for air conditioning and refrigeration equipment," JRA, Tokyo, 2016, (38 pages total).
International Search Report (PCT/ISA/210) issued in PCT/JP2020/040900, dated Dec. 22, 2020.

* cited by examiner

AIR CONDITIONING APPARATUS

CROSS REFERENCE TO RELATED APPLICATIONS

This application is a Continuation of PCT International Application No. PCT/JP2020/040900, filed on Oct. 30, 2020, which claims priority under 35 U.S.C. 119(a) to Patent Application No. 2019-201071, filed in Japan on Nov. 5, 2019, all of which are hereby expressly incorporated by reference into the present application.

TECHNICAL FIELD

The present disclosure relates to an air conditioning apparatus.

BACKGROUND ART

An air conditioning apparatus may be provided with various safety devices as a measure against refrigerant leakage. For example, Patent Literature 1 (JP 2019-52785 A) discloses an air conditioning system including a refrigerant detector, an alarm device, and an isolation valve as safety devices.

SUMMARY

An air conditioning apparatus of a first aspect is an air conditioning apparatus including a refrigerant circuit, and includes a connecting portion, a circuit configuration portion, a first member, and a control unit. To the connecting portion, a first electric wire connected to a first device of a plurality of safety devices and a second electric wire connected to a second device of the plurality of safety devices are connected. The plurality of safety devices includes at least two types of a refrigerant detector, an alarm device, an isolation valve, and a ventilation device. The second device is different from the first device in type. The circuit configuration portion forms an interlock circuit together with the first electric wire and the second electric wire connected to the connecting portion. The first member can form a first circuit including at least part of the circuit configuration portion without going through the first electric wire and the second electric wire. The control unit prohibits an operation of the air conditioning apparatus when no current flows through either the interlock circuit or the first circuit.

Note that the case where no current flows through the interlock circuit includes the case where part of the interlock circuit is broken and the case where part of the interlock circuit is disconnected from the electric wire, in addition to the case where the interlock circuit does not exist. The case where no current flows through the first circuit includes the case where the first circuit is not formed.

DESCRIPTION OF EMBODIMENT

One embodiment of an air conditioning apparatus of the present disclosure will be described.

(1) Air Conditioning System

Figure 1:
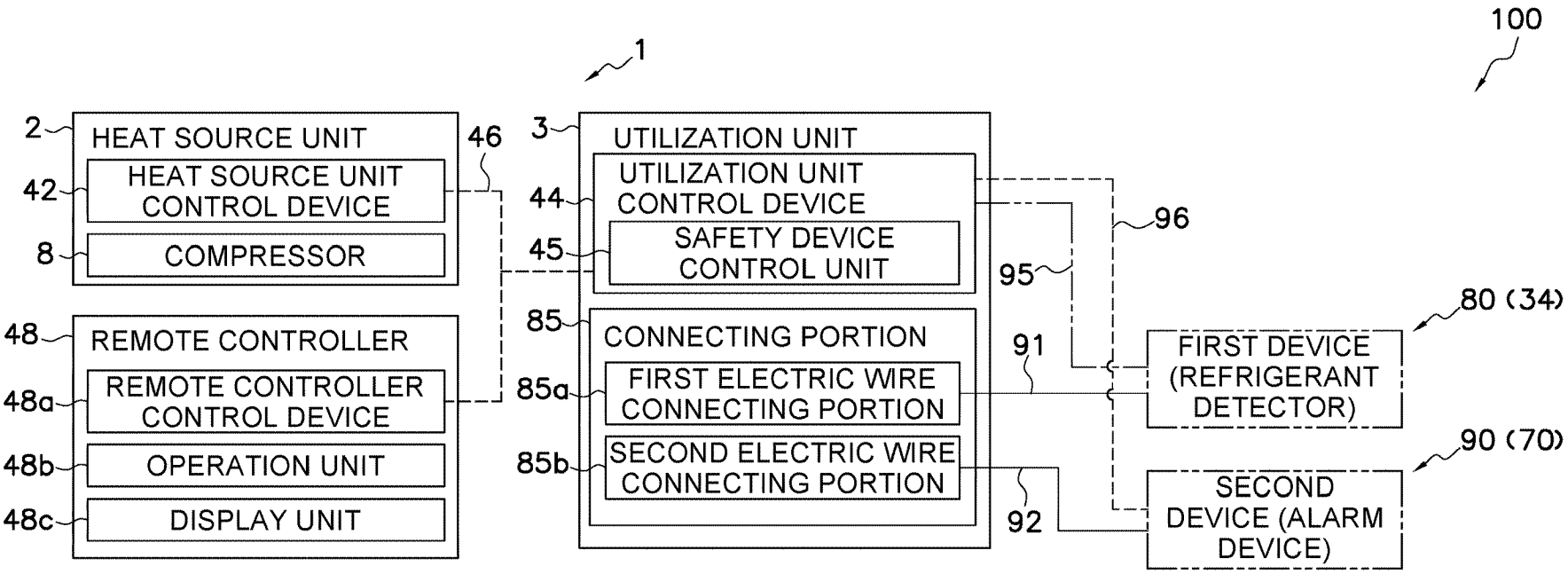
FIG. 1 is a block diagram of an air conditioning system including an air conditioning apparatus according to one embodiment of the present disclosure.
Figure 2:
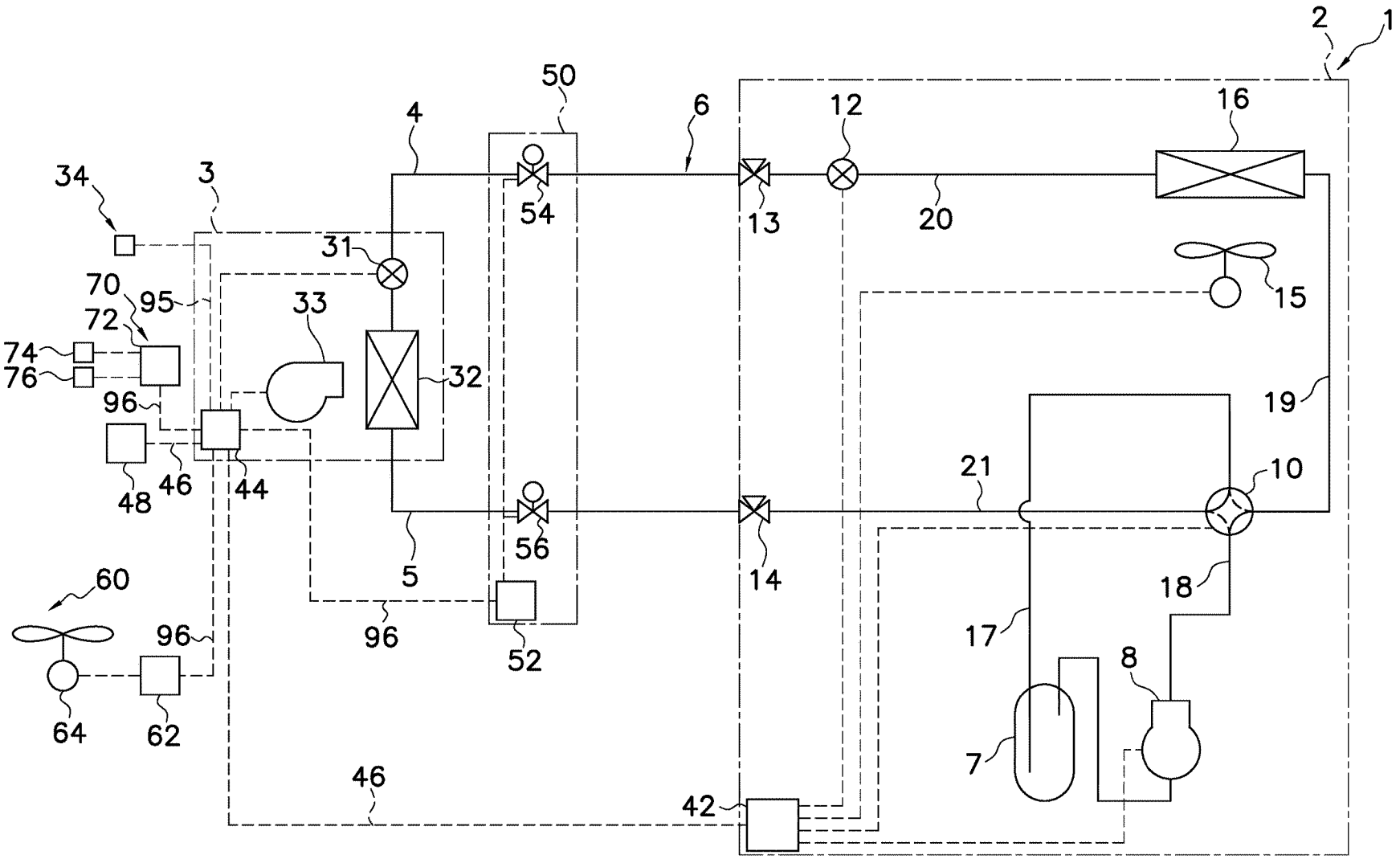
FIG. 2 is a schematic configuration diagram of the air conditioning system of FIG. 1.

With reference to FIGS. 1 and 2, an air conditioning system 100 including an air conditioning apparatus 1 according to one embodiment and a plurality of types of safety devices will be described. FIG. 1 is a block diagram of the air conditioning system 100. In FIG. 1, depiction of devices constituting a refrigerant circuit 6 excluding a compressor 8 of a heat source unit 2 of the air conditioning apparatus 1, a first fan 15, and a second fan 33 is omitted. FIG. 2 is a schematic configuration diagram of the air conditioning system 100.

The air conditioning apparatus 1 is an apparatus to cool or heat air conditioning target space by using a vapor compression refrigeration cycle. The air conditioning apparatus 1 includes a utilization unit 3 and the heat source unit 2 (see FIG. 1).

In the present embodiment, the plurality of types of safety devices included in the air conditioning system 100 includes four types of safety devices: refrigerant detector 34, alarm device 70, ventilation device 60, and isolation valve 50 (see FIG. 2).

Note that in the following, when describing the interlock function of the air conditioning apparatus 1, in order to avoid complicated description, the case where the air conditioning system 100 includes two types of safety devices (first device 80 and second device 90) will be described. The following embodiment will mainly describe, as an example, the case where the first device 80 is the refrigerant detector 34 and the second device 90 is the alarm device 70. Note that for example, the first device 80 and the second device 90 may be another combination of the plurality of types of safety devices.

(2) Detailed Configuration (2-1) Air Conditioning Apparatus

The air conditioning apparatus 1 is an apparatus to cool and heat the air conditioning target space by using the vapor compression refrigeration cycle. Examples of the air conditioning target space include a space in a building such as an office building, a commercial facility, or a residence. Note that the air conditioning apparatus 1 may not be an apparatus to be used for both cooling and heating uses of the air conditioning target space, but may be, for example, an apparatus to be used for only one of cooling and heating uses.

The air conditioning apparatus 1 is configured to electrically connect various safety devices in order to ensure safety when a refrigerant leaks. The air conditioning apparatus 1 has an interlock function. The interlock function here is a function of prohibiting activation and operation of the air conditioning apparatus 1 when the safety devices required for the air conditioning system 100 are not supplied with power and are not operational.

However, the air conditioning apparatus 1 is configured to be operational even when the safety devices are not connected, by forming a first circuit 99 using the first member 110 described later.

The air conditioning apparatus 1 mainly includes the heat source unit 2, the utilization unit 3, a refrigerant connection pipe, and a remote controller 48, as shown in FIGS. 2 and 3. In addition, the air conditioning apparatus 1 includes a connecting portion 85, a circuit configuration portion 97, and the first member 110 related to the interlock function and release thereof.

The heat source unit 2 includes a heat source unit control device 42. The utilization unit 3 includes a utilization unit control device 44. The remote controller 48 includes a remote controller control device 48*a*. The heat source unit control device 42, the utilization unit control device 44, and the remote controller control device 48*a* cooperate to function as the control unit 22 described later.

The refrigerant connection pipe includes a liquid refrigerant connection pipe 4 and a gas refrigerant connection pipe 5. The liquid refrigerant connection pipe 4 and the gas refrigerant connection pipe 5 are refrigerant connection pipes to connect the heat source unit 2 to the utilization unit 3. In the air conditioning apparatus 1, the heat source unit 2 and the utilization unit 3 are connected via the refrigerant connection pipes 4 and 5 to constitute the refrigerant circuit 6.

The refrigerant enclosed in the refrigerant circuit 6 is, but is not limited to, a flammable refrigerant. The flammable refrigerant includes the refrigerant categorized as Class 3 (higher flammability). Class 2 (lower flammability), and Subclass 2L (slight flammability) in the standards according to ASHRAE 34, Designation and Safety Classification of Refrigerants in the Unites States or the standards according to ISO 817, Refrigerants—Designation and Safety Classification.

An example of the adopted refrigerant is any one of R1234yf. R1234ze(E), R516A, R445A, R444A, R454C. R444B, R454A, R455A, R457A, R459B, R452B, R454B, R447B, R32, R447A, R446A, and R459A.

In the present embodiment, the refrigerant used is R32. Note that the present disclosure is also useful for a case where the refrigerant is not flammable.

The air conditioning apparatus 1 includes one heat source unit 2 as shown in FIG. 2. In addition, the air conditioning apparatus 1 includes one utilization unit 3 as shown in FIG. 2. However, the air conditioning apparatus 1 may include a plurality of utilization units 3 connected in parallel to the heat source unit 2. The air conditioning apparatus 1 may include a plurality of heat source units 2.

The heat source unit 2, the utilization unit 3, the refrigerant connection pipes 4 and 5, and the control unit 22 will be described in detail below. The circuit configuration portion 97, the connecting portion 85, a mounting portion 25, and the first member 110 related to the interlock function of the air conditioning apparatus 1 and release of the interlock function will be described in detail below.

(2-1-4) Heat Source Unit

One example of the configuration of the heat source unit 2 will be described with reference to FIG. 2.

The heat source unit 2 is installed outside the air conditioning target space, for example, on the roof of a building, near a wall surface of a building, or the like.

The heat source unit 2 mainly includes an accumulator 7, the compressor 8, a flow direction switching mechanism 10, a heat source heat exchanger 16, a first expansion mechanism 12, a first shutoff valve 13, a second shutoff valve 14, and the first fan 15 (see FIG. 2). Note that the heat source unit 2 may not include some of the devices described here. For example, in a case where the air conditioning apparatus 1 only cools the air conditioning target space, the heat source unit 2 may not include the flow direction switching mechanism 10. The heat source unit 2 may include, as necessary, a device not described here.

The heat source unit 2 mainly includes, as refrigerant pipes connecting various devices constituting the refrigerant circuit 6, a suction pipe 17, a discharge pipe 18, a first gas refrigerant pipe 19, a liquid refrigerant pipe 20, and a second gas refrigerant pipe 21 (see FIG. 2). The suction pipe 17 connects the flow direction switching mechanism 10 to a suction side of the compressor 8. The suction pipe 17 is provided with the accumulator 7. The discharge pipe 18 connects a discharge side of the compressor 8 to the flow direction switching mechanism 10. The first gas refrigerant pipe 19 connects the flow direction switching mechanism 10 to a gas side of the heat source heat exchanger 16. The liquid refrigerant pipe 20 connects a liquid side of the heat source heat exchanger 16 to the first shutoff valve 13. The liquid refrigerant pipe 20 is provided with the first expansion mechanism 12. The second gas refrigerant pipe 21 connects the flow direction switching mechanism 10 to the second shutoff valve 14.

The compressor 8 is a device to suck a low-pressure refrigerant in the refrigeration cycle from the suction pipe 17, compress the refrigerant by means of a compression mechanism (not shown), and discharge the compressed refrigerant to the discharge pipe 18.

The flow direction switching mechanism 10 switches a refrigerant flow direction to change a state of the refrigerant circuit 6 between a first state and a second state. In the present embodiment, the flow direction switching mechanism 10 is a four-way switching valve, but is not limited to this example and may include a plurality of valves and pipes. When the refrigerant circuit 6 is in the first state, the heat source heat exchanger 16 functions as a refrigerant radiator (condenser) and a utilization heat exchanger 32 functions as a refrigerant evaporator. When the refrigerant circuit 6 is in the second state, the heat source heat exchanger 16 functions as a refrigerant evaporator and the utilization heat exchanger 32 functions as a refrigerant radiator. When the flow direction switching mechanism 10 brings the refrigerant circuit 6 into the first state, the flow direction switching mechanism 10 causes the suction pipe 17 to communicate with the second gas refrigerant pipe 21 and causes the discharge pipe 18 to communicate with the first gas refrigerant pipe 19 (see solid lines in the flow direction switching mechanism 10 in FIG. 2). When the flow direction switching mechanism 10 brings the refrigerant circuit 6 into the second state, the flow direction switching mechanism 10 causes the suction pipe 17 to communicate with the first gas refrigerant pipe 19 and causes the discharge pipe 18 to communicate with the second gas refrigerant pipe 21 (see broken lines in the flow direction switching mechanism 10 in FIG. 2). The heat source heat exchanger 16 is a device to cause heat exchange between a refrigerant flowing inside and air at an installation site of the heat source unit 2 (heat source air). The heat source heat exchanger 16 is, but is not limited to any type, for example, a fin-and-tube heat exchanger including a plurality of heat transfer tubes and fins (not shown).

The heat source heat exchanger 16 has a first end connected to the first gas refrigerant pipe 19. The heat source heat exchanger 16 has a second end connected to the liquid refrigerant pipe 20.

The first expansion mechanism 12 is disposed between the heat source heat exchanger 16 and the utilization heat exchanger 32 in the refrigerant circuit 6. The first expansion mechanism 12 is disposed in the liquid refrigerant pipe 20 between the heat source heat exchanger 16 and the first shutoff valve 13. The first expansion mechanism 12 adjusts pressure and a flow rate of the refrigerant flowing through the liquid refrigerant pipe 20. In the present embodiment, the first expansion mechanism 12 is an electronic expansion valve having a variable opening degree. However, for example, the first expansion mechanism 12 may be a temperature sensitive cylinder expansion valve, a capillary tube, or the like.

The accumulator 7 is a container having a gas-liquid separation function of separating an influent refrigerant into a gas refrigerant and a liquid refrigerant. The accumulator 7 is also a container having a function of storing an excess refrigerant generated in response to fluctuations in the operating load and the like.

The first shutoff valve 13 is a valve provided at a connecting portion between the liquid refrigerant pipe 20 and the liquid refrigerant connection pipe 4. The second shutoff valve 14 is a valve provided at a connecting portion between the second gas refrigerant pipe 21 and the gas refrigerant connection pipe 5. The first shutoff valve 13 and the second shutoff valve 14 are opened while the air conditioning apparatus 1 is in operation.

The first fan 15 is a fan to suck heat source air outside the heat source unit 2 into a casing (not shown) of the heat source unit 2, supply the heat source heat exchanger 16 with the heat source air, and discharge air subjected to heat exchange with the refrigerant in the heat source heat exchanger 16 out of the casing of the heat source unit 2. The first fan 15 is, for example, a propeller fan. However, the type of the first fan 15 is not limited to the propeller fan and may be appropriately selected.

(2-1-2) Utilization Unit

One example of the configuration of the utilization unit 3 will be described with reference to FIG. 2.

The utilization unit 3 is, for example, a unit installed in the air conditioning target space. The utilization unit 3 is, for example, a ceiling embedded type unit, but alternatively may be a ceiling pendant type, a wall mounted type, or a floor-standing type unit. The utilization unit 3 may be disposed outside the air conditioning target space. For example, the utilization unit 3 may be installed in an attic space, a machine chamber, or the like. In this case, there is disposed an air passage to supply air subjected to heat exchange with a refrigerant in the utilization heat exchanger 32 from the utilization unit 3 to the air conditioning target space. Examples of the air passage include a duct. However, the type of air passage is not limited to a duct, and may be appropriately selected.

The utilization unit 3 mainly includes a second expansion mechanism 31, the utilization heat exchanger 32, and the second fan 33 (see FIG. 2).

The second expansion mechanism 31 is disposed between the heat source heat exchanger 16 and the utilization heat exchanger 32 in the refrigerant circuit 6. The second expansion mechanism 31 is disposed in a refrigerant pipe connecting the utilization heat exchanger 32 to the liquid refrigerant connection pipe 4. The second expansion mechanism 31 adjusts pressure and a flow rate of the refrigerant flowing through the refrigerant pipe. In the present embodiment, the second expansion mechanism 31 is, but is not limited to, an electronic expansion valve having a variable opening degree.

The utilization heat exchanger 32 causes heat exchange between the refrigerant flowing through the utilization heat exchanger 32 and air in the air conditioning target space. The utilization heat exchanger 32 is, but is not limited to any type, for example, a fin-and-tube heat exchanger including a plurality of heat transfer tubes and fins (not shown). The utilization heat exchanger 32 has a first end connected to the liquid refrigerant connection pipe 4 via the refrigerant pipe. The utilization heat exchanger 32 has a second end connected to the gas refrigerant connection pipe 5 via the refrigerant pipe.

The second fan 33 is a mechanism to suck air in the air conditioning target space into a casing (not shown) of the utilization unit 3, supply the air to the utilization heat exchanger 32, and blow out the air subjected to heat exchange with the refrigerant in the utilization heat exchanger 32 to the air conditioning target space. Examples of the second fan 33 include a turbo fan. However, the type of the second fan 33 is not limited to a turbo fan, and may be appropriately selected.

(2-1-3) Liquid Refrigerant Connection Pipe and Gas Refrigerant Connection Pipe

The liquid refrigerant connection pipe 4 and the gas refrigerant connection pipe 5 are refrigerant connection pipes to connect the heat source unit 2 to the utilization unit 3. The liquid refrigerant connection pipe 4 is provided with a first isolation valve 54 of the isolation valve 50. The gas refrigerant connection pipe 5 is provided with a second isolation valve 56 of the isolation valve 50.

The first isolation valve 54 and the second isolation valve 56 are, but are not limited to, electromagnetic valves or motor operated valves, for example. The first isolation valve 54, when closed, can prevent the refrigerant from flowing in from the heat source unit 2 side of the first isolation valve 54 into the utilization unit 3 through the liquid refrigerant connection pipe 4. The second isolation valve 56, when closed, can prevent the refrigerant from flowing in from the heat source unit 2 side of the second isolation valve 56 into the utilization unit 3 through the gas refrigerant connection pipe 5.

(2-1-4) Control Unit

The control unit 22 includes the heat source unit control device 42, the utilization unit control device 44, and the remote controller control device 48*a*. In other words, the heat source unit control device 42, the utilization unit control device 44, and the remote controller control device 48*a* cooperate to function as the control unit 22. Note that the control unit 22 is required at least to function as described below as a whole. Therefore, the operation described below as being performed by any of the heat source unit control device 42, the utilization unit control device 44, and the remote controller control device 48*a* may be performed by the other control device 42, 44, or 48*a* within a consistent range. Part of the function of the control unit 22 described below may be performed by another control device provided separately from the heat source unit control device 42, the utilization unit control device 44, and the remote controller control device 48*a*.

Figure 5:
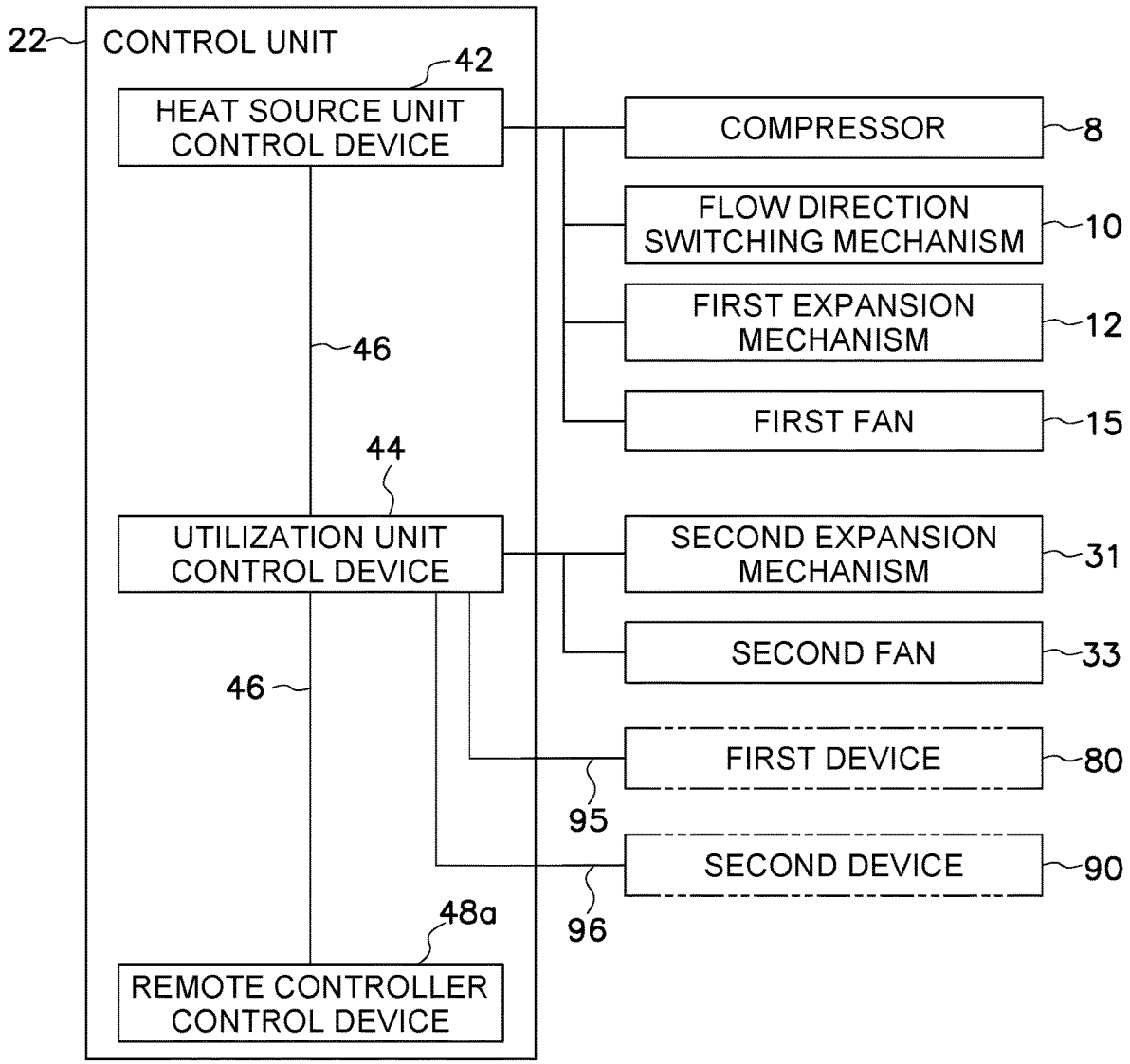
FIG. 5 is a block diagram of a control unit of the air conditioning apparatus of FIG. 1.

The control unit 22 is configured by connecting the heat source unit control device 42, the utilization unit control device 44, and the remote controller control device 48*a* via a communication line 46 (see FIG. 5).

To control operations of various devices of the air conditioning apparatus 1, the control unit 22 mainly includes a microcontroller unit (MCU), and various electric circuits and electronic circuits. The MCU includes a CPU, memory, I/O interface, and the like.

Various programs to be executed by the CPU of the MCU are stored in the memory of the MCU. Note that various functions of the control unit 22 described below may be implemented by hardware, software, or hardware and software cooperating with each other.

The control unit 22 controls the operations of various devices of the air conditioning apparatus 1 based on instructions input to the remote controller 48, measured values of various sensors provided in the heat source unit 2 and the utilization unit 3, and the like.

For example, during a cooling operation, the control unit 22 controls the operation of the flow direction switching mechanism 10 to switch the state of the refrigerant circuit 6 to the first state in which the heat source heat exchanger 16 functions as a refrigerant radiator and the utilization heat exchanger 32 functions as a refrigerant evaporator. During the cooling operation, the control unit 22 operates the compressor 8, the first fan 15, and the second fan 33. During the cooling operation, the control unit 22 adjusts the number of revolutions of motors of the compressor 8, the first fan 15, and the second fan 33, and the opening degree of the electronic expansion valve, which is an example of the first expansion mechanism 12 and the second expansion mechanism 31, to a predetermined opening degree, based on the measured values of various sensors, set temperature, and the like. Meanwhile, during a heating operation, the control unit 22 controls the operation of the flow direction switching mechanism 10 to switch the state of the refrigerant circuit 6 to the second state in which the heat source heat exchanger 16 functions as a refrigerant evaporator and the utilization heat exchanger 32 functions as a refrigerant radiator. During the heating operation, the control unit 22 operates the compressor 8, the first fan 15, and the second fan 33. During the heating operation, the control unit 22 adjusts the number of revolutions of motors of the compressor 8, the first fan 15, and the second fan 33, and the opening degree of the electronic expansion valve, which is an example of the first expansion mechanism 12 and the second expansion mechanism 31, to a predetermined opening degree, based on the measured values of various sensors, set temperature, and the like.

Specific control of the operations of various devices of the air conditioning apparatus 1 during the cooling operation and the heating operation has various control modes that are publicly known. Therefore, description will be omitted here to avoid complicated description.

The control unit 22 determines refrigerant leakage based on a detection signal output from the refrigerant detector 34. On determination that the refrigerant is leaking, the control unit 22 transmits a signal for executing an operation when the refrigerant leakage is detected to the alarm device 70, the ventilation device 60, and the isolation valve 50 serving as safety devices. On determination that the refrigerant is leaking, the control unit 22 prohibits or stops the operation of the air conditioning apparatus 1.

The heat source unit control device 42, the utilization unit control device 44, and the remote controller 48 including the remote controller control device 48*a* will be described in detail below.

(2-1-4-1) Heat Source Unit Control Device

The heat source unit control device 42 mainly includes a microcontroller unit (MCU), and various electric circuits and electronic circuits to control various devices of the heat source unit 2. The MCU includes a CPU, memory, I/O interface, and the like.

Various programs to be executed by the CPU of the MCU are stored in the memory of the MCU. Note that various functions of the heat source unit control device 42 described below may be implemented by hardware, software, or hardware and software cooperating with each other.

The heat source unit control device 42 is electrically connected to various devices of the heat source unit 2, including the compressor 8, the flow direction switching mechanism 10, the first expansion mechanism 12, and the first fan 15 (see FIG. 2). The heat source unit control device 42 is electrically connected to a sensor (not shown) provided in the heat source unit 2. The sensor includes, but is not limited to, a temperature sensor or a pressure sensor provided in the discharge pipe 18 and the suction pipe 17, a temperature sensor provided in the heat source heat exchanger 16, a temperature sensor provided in the liquid refrigerant pipe 20, a temperature sensor that measures the temperature of the heat source air, and the like.

The heat source unit control device 42 is connected to the utilization unit control device 44 via the communication line 46. By exchanging a control signal for the air conditioning apparatus 1 via the communication line 46, the heat source unit control device 42 and the utilization unit control device 44 function as the control unit 22 that controls the operation of the air conditioning apparatus 1 described above. The control signal for the air conditioning apparatus 1 is a signal used to control various devices of the air conditioning apparatus 1.

On receipt of an operation prohibition signal transmitted from the utilization unit control device 44 via the communication line 46, the heat source unit control device 42 performs operation prohibition control on various devices of the heat source unit 2. The operation prohibition signal will be described later. The operation prohibition control performed by the heat source unit control device 42 is control to prohibit at least the operation of the compressor 8. In the operation prohibition control performed by the heat source unit control device 42, the operation of the first fan 15 may also be prohibited in addition to the operation of the compressor 8. In the present embodiment, the heat source unit control device 42 prohibits the operation of the compressor 8 and the first fan 15 as the operation prohibition control.

Specifically, the heat source unit control device 42 prohibits the activation of the compressor 8 and the first fan 15 of the nonoperational heat source unit 2 as the operation prohibition control. The heat source unit control device 42 may stop the compressor 8 and the first fan 15 of the heat source unit 2 in operation as the operation prohibition control. When stopping the compressor 8 and the first fan 15 of the heat source unit 2 in operation as the operation prohibition control, the heat source unit control device 42 may stop the compressor 8 and the first fan 15 in a similar manner to when the air conditioning operation is stopped normally. Alternatively, when stopping the compressor 8 and the first fan 15 of the heat source unit 2 in operation as the operation prohibition control, the heat source unit control device 42 may stop the compressor 8 and the first fan 15 in a manner different from when the air conditioning operation is stopped normally.

On receipt of a leakage detection signal transmitted from the utilization unit control device 44 via the communication line 46, the heat source unit control device 42 performs leakage control on various devices of the heat source unit 2. The leakage detection signal ill be described later. The leakage control performed by the heat source unit control device 42 is, for example, control to prohibit activation of the compressor 8 and the first fan 15 of the nonoperational heat source unit 2. The leakage control performed by the heat source unit control device 42 is control to stop the compressor 8 and the first fan 15 of the heat source unit 2 in operation. When stopping the compressor 8 and the first fan 15 of the heat source unit 2 in operation as the leakage control, the heat source unit control device 42 may stop the compressor 8 and the first fan 15 in a similar manner to when the air conditioning operation is stopped normally, or in a similar manner to the operation prohibition control. Alternatively, the heat source unit control device 42 may stop the compressor 8 and the first fan 15 in a manner different from when the air conditioning operation is stopped normally, or the operation prohibition control.

(2-1-4-2) Utilization Unit Control Device

The utilization unit control device 44 includes a microcontroller unit (MCU) and various electric circuits and electronic circuits. The MCU includes a CPU, memory, I/O interface, and the like. Various programs to be executed by the CPU of the MCU are stored in the memory of the MCU. Note that various functions of the utilization unit control device 44 described below may be implemented by hardware, software, or hardware and software cooperating with each other. Part of various functions of the utilization unit control device 44 described below may be performed by a control device provided separately from the utilization unit control device 44.

The utilization unit control device 44 is electrically connected to various devices of the utilization unit 3, including the second expansion mechanism 31 and the second fan 33, to control various devices of the utilization unit 3. (See FIG. 2). The utilization unit control device 44 is electrically connected to a sensor provided in the utilization unit 3 (not shown). The sensor includes, but is not limited to, a temperature sensor provided in the utilization heat exchanger 32 and the liquid side refrigerant pipe connected to the utilization heat exchanger 32, a temperature sensor that measures the temperature of the air conditioning target space, and the like.

The utilization unit control device 44 is connected to the heat source unit control device 42 via the communication line 46 as described above. The utilization unit control device 44 is communicably connected to the remote controller 48 via the communication line 46. The utilization unit control device 44 functions as the control unit 22 that controls the operation of the air conditioning apparatus 1, together with the heat source unit control device 42 and the remote controller 48.

The utilization unit control device 44 is electrically connected to the refrigerant detector 34 via a signal line 95. Furthermore, the utilization unit control device 44 is electrically connected to the alarm device 70, the ventilation device 60, and the isolation valve 50 serving as safety devices via a signal line 96.

The utilization unit control device 44 is configured to receive the detection signal output from the refrigerant detector 34. The utilization unit control device 44 determines refrigerant leakage based on the detection signal output from the refrigerant detector 34. On determination that the refrigerant is leaking, the utilization unit control device 44 transmits the leakage detection signal to the heat source unit control device 42 and the remote controller control device 48*a*.

Furthermore, on determination that the refrigerant is leaking, the utilization unit control device 44 performs leakage control on various devices of the utilization unit 3. The leakage control performed by the utilization unit control device 44 is, for example, control to prohibit activation of the nonoperational second fan 33 of the utilization unit 3. The leakage control performed by the utilization unit control device 44 is control to prohibit activation of the second fan 33 of the utilization unit 3 in operation. Note that when stopping the second fan 33 in operation as the leakage control, the utilization unit control device 44 may stop the second fan 33 in a similar manner to when the air conditioning operation is stopped normally, or in a similar manner to the operation prohibition control. Alternatively, the utilization unit control device 44 may stop the second fan 33 in a manner different from when the air conditioning operation is stopped normally, or the operation prohibition control.

The utilization unit control device 44 includes a safety device control unit 45 that controls the operation of the safety device as a functional unit. When the utilization unit control device 44 determines that the refrigerant is leaking based on the detection signal output from the refrigerant detector 34, the safety device control unit 45 operates the safety device. For example, as the safety device in the air conditioning system 100, it is assumed that the refrigerant detector 34 serving as the first device 80 and the alarm device 70 serving as the second device 90 are used. In this case, when refrigerant leakage is detected based on the signal output from the refrigerant detector 34, the safety device control unit 45 transmits a signal for performing the operation when the refrigerant leakage is detected to the alarm device 70 via the signal line 96.

Note that out of functions of the utilization unit control device 44, details of the interlock function of the air conditioning apparatus 1 will be described later.

(2-1-4-3) Remote Controller

The remote controller 48 is a device for operating the air conditioning apparatus 1. The remote controller 48, whose installation position is not limited, is attached to a wall of the air conditioning target space, for example. The remote controller 48 is communicably connected to the utilization unit control device 44 via the communication line 46.

The remote controller 48 includes the remote controller control device 48*a* including a microcontroller unit (MCU), and various electric circuits and electronic circuits. The remote controller control device 48*a* functions as the control unit 22 that controls the operation of the air conditioning apparatus 1, together with the heat source unit control device 42 and the utilization unit control device 44. The MCU includes a CPU, memory, I/O interface, and the like. Various programs to be executed by the CPU of the MCU are stored in the memory of the MCU. Note that various functions of the remote controller 48 described below may be implemented by hardware, software, or hardware and software cooperating with each other.

The remote controller 48 also includes an operation unit 48*b* and a display unit 48*c*.

The operation unit 48*b* is a functional unit into which a person inputs various commands for the air conditioning apparatus 1 and includes various switches and a touch panel.

The display unit 48*c* displays settings for the air conditioning apparatus 1 and a state of the air conditioning apparatus 1. As the state of the air conditioning apparatus 1, the display unit 48*c* displays that the operation of the air conditioning apparatus 1 is prohibited by the interlock function. Specifically, when the remote controller control device 48*a* receives the operation prohibition signal from the utilization unit control device 44, the display unit 48*c* displays that the operation of the air conditioning apparatus 1 is prohibited by the interlock function. In addition, as the state of the air conditioning apparatus 1, the display unit 48*c* displays that the operation of the air conditioning apparatus 1 is prohibited as a result of refrigerant leakage being detected by the refrigerant detector 34. Specifically, when the remote controller control device 48*a* receives the leakage detection signal from the utilization unit control device 44, the display unit 48*c* displays that the operation of the air conditioning apparatus 1 is prohibited because of the refrigerant leakage.

(2-1-5) Interlock Function

Figure 3A:
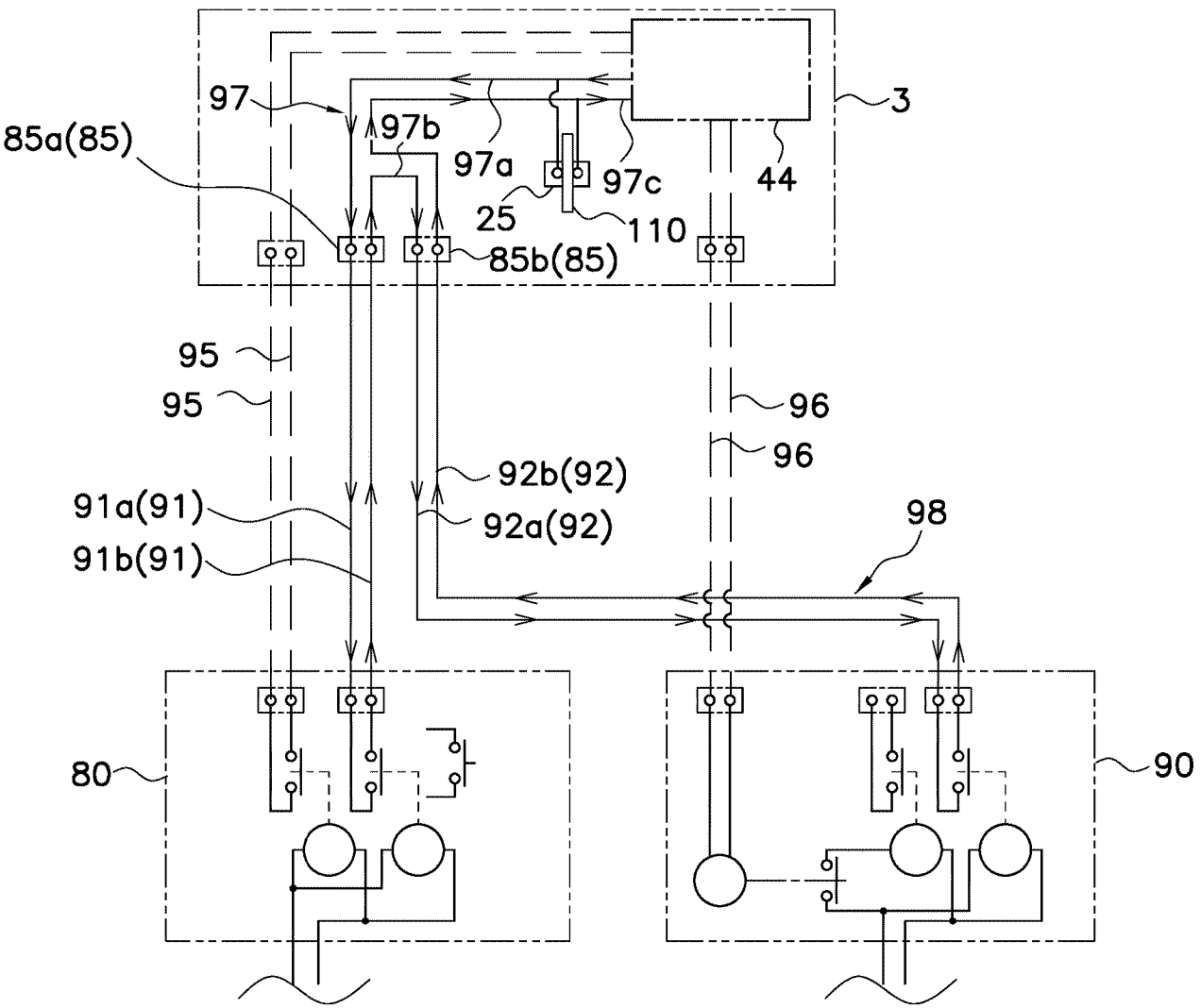
FIG. 3A is a schematic electrical circuit diagram for describing an interlock circuit of the air conditioning apparatus of FIG. 1.
Figure 3B:
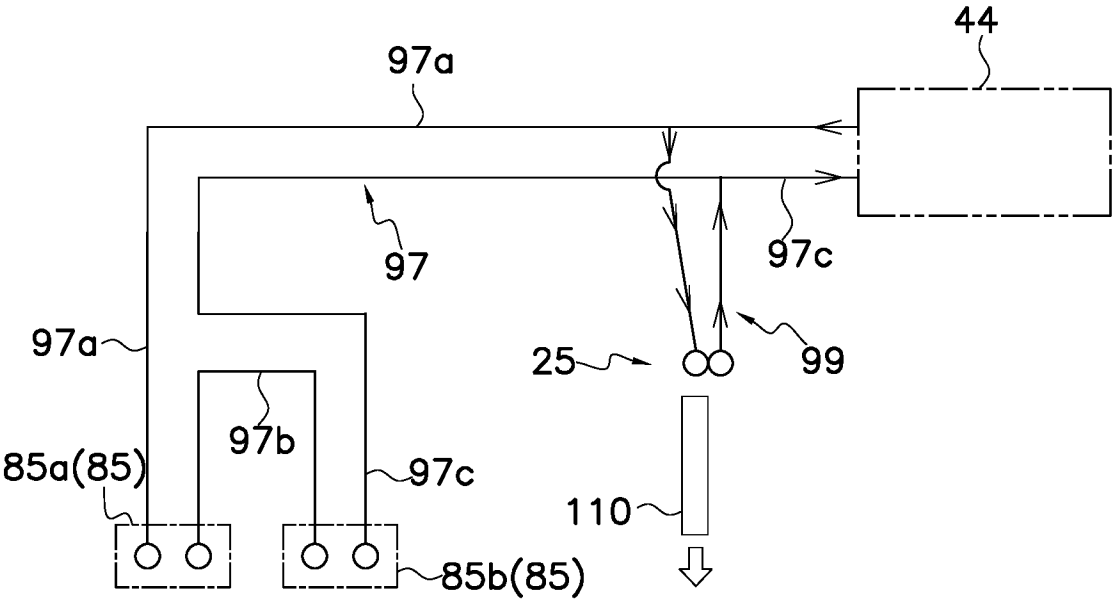
FIG. 3B is a schematic electrical circuit diagram for describing a first circuit including part of a circuit configuration portion of FIG. 3A.
Figure 4A:
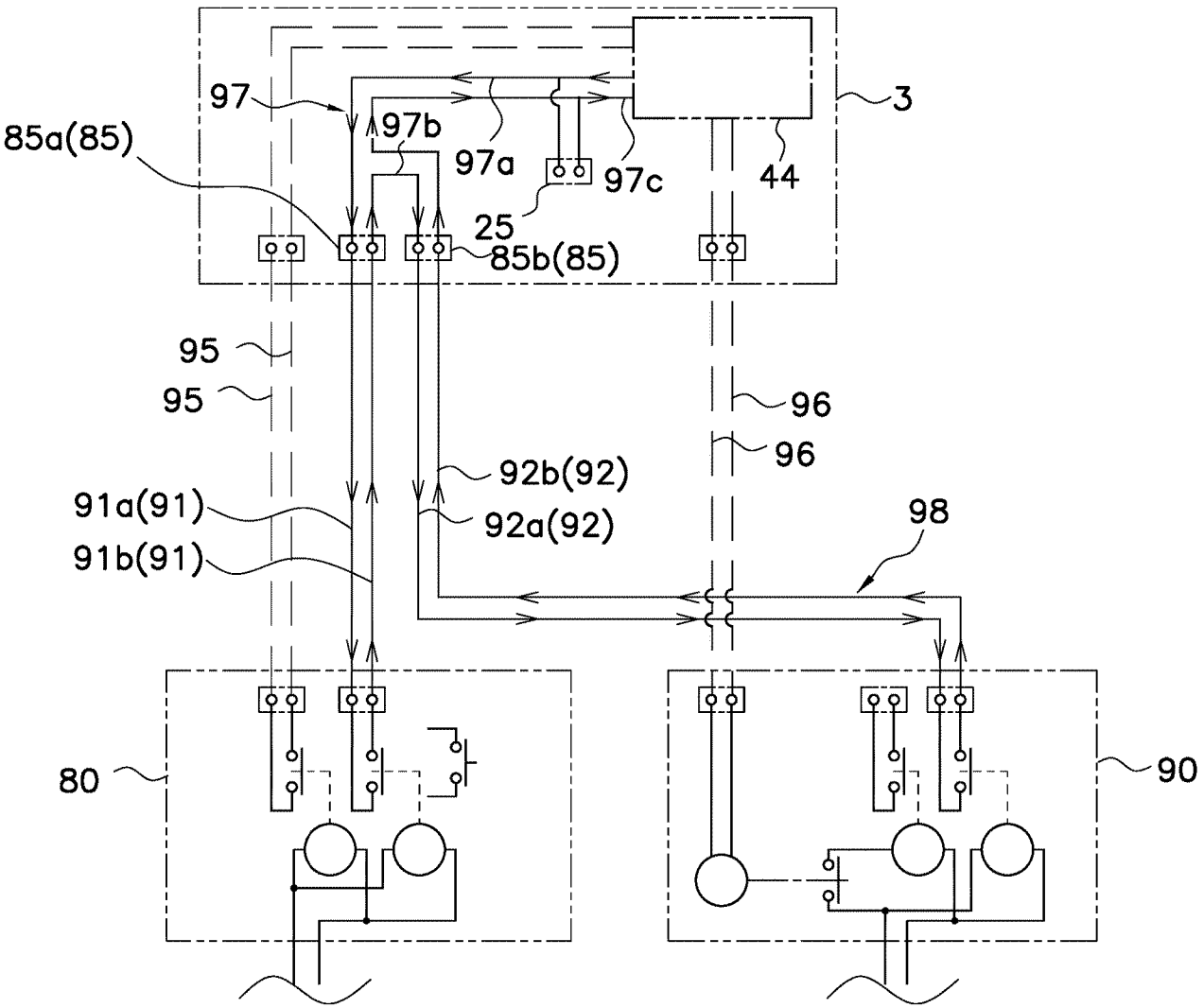
FIG. 4A is a schematic electrical circuit diagram for describing another example of the interlock circuit of the air conditioning apparatus of FIG. 1.
Figure 4B:
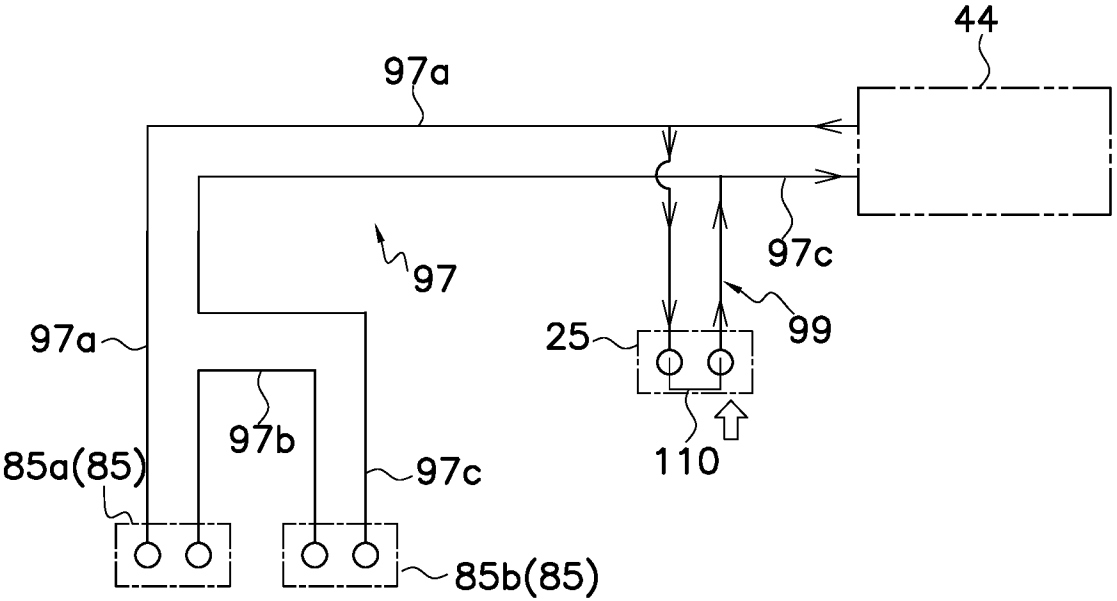
FIG. 4B is an electrical circuit diagram for describing another example of the first circuit including part of the circuit configuration portion of FIG. 4A.

Next, the interlock function of the air conditioning apparatus 1 and the configuration related to the release thereof will be described with reference to FIGS. 3A, 3B, 4A, and 4B. FIG. 3A is a schematic electrical circuit diagram for describing an interlock circuit 98 of the air conditioning apparatus 1. FIG. 3B is an electrical circuit diagram for describing the first circuit 99 of the air conditioning apparatus 1. FIG. 4A is a schematic electrical circuit diagram for describing another example of the interlock circuit 98 of the air conditioning apparatus 1. FIG. 4B is an electrical circuit diagram for describing another example of the first circuit 99 of the air conditioning apparatus 1.

First, the interlock function will be described. The interlock function here is a function of prohibiting the activation and operation of the air conditioning apparatus 1 when the safety devices required for the air conditioning system 100 are not supplied with power and are not operational.

The configuration to implement the interlock function will be described. The safety devices and the utilization unit control device 44 of the air conditioning apparatus 1 are connected by an interlocking electric wire to form the interlock circuit 98. The utilization unit control device 44 supplies a current to the interlock circuit 98. Note that each safety device includes a circuit configuration portion that constitutes part of the circuit of the interlock circuit 98. In the circuit configuration portion of each safety device, a rheotome of the electric circuit exists. In the circuit configuration portion of each safety device, a switch is provided to connect the rheotome of the electric circuit of the circuit configuration portion when power is supplied to the safety device. As a result of such a configuration, when the safety devices and the utilization unit control device 44 are connected via the electric wire and power is supplied to the safety devices, a current flows through the interlock circuit 98. Meanwhile, when any one of the safety devices and the utilization unit control device 44 are not connected via the electric wire, or when power is not supplied to any one of the safety devices, no current flows through the interlock circuit 98. More specifically, when any one of the safety devices is not connected to the utilization unit control device 44, or when power is not supplied to any one of the safety devices, the interlock circuit 98 is not formed (circuit is not closed) because the electric circuit includes the rheotome.

The utilization unit control device 44 detects whether or not a current is flowing through the interlock circuit 98, and prohibits the operation of the utilization unit 3 and transmits the operation prohibition signal to the heat source unit control device 42 if no current flows through the interlock circuit 98. Note that for the detection of whether or not a current is flowing through the interlock circuit 98, for example, a relay, an ammeter, or a disconnection detector may be used, although not restrictive.

Note that the air conditioning system 100 may not require safety devices depending on the amount of refrigerant charged into the air conditioning apparatus 1, the size of the air conditioning target space, the type of refrigerant charged into the air conditioning apparatus 1, and the like. In that case, the interlock function of the air conditioning apparatus 1 is unnecessary. Therefore, the air conditioning apparatus 1 is configured to form the first circuit 99 by using the first member 110 described later. The air conditioning apparatus 1 is configured to be operational when a current flows through the first circuit 99, even if there is no safety device and there is no electric wire connection between the safety device and the utilization unit control device 44 of the air conditioning apparatus 1.

The connecting portion 85, the circuit configuration portion 97, the mounting portion 25, and the first member 110, which are the configuration to implement the interlock function and release thereof, will be described below. Note that although not restrictive, in the present embodiment, the connecting portion 85, the circuit configuration portion 97, and the mounting portion 25 are provided in the utilization unit 3.

Note that as described above, the air conditioning system 100 of the present embodiment includes four types of safety devices. However, here, in order to avoid complicated description, excluding the case where the air conditioning system 100 does not require safety devices, the case where it is necessary to install two types of safety devices (first device 80 and second device 90) will be described as an example. Here, the case where the first device 80 is the refrigerant detector 34 and the second device 90 is the alarm device 70 will be described as an example.

(2-1-5-1) Connecting Portion

The connecting portion 85 is a portion to which electric wires connecting to the safety devices are connected. The connecting portion 85 includes a first electric wire connecting portion 85*a* and a second electric wire connecting portion 85*b* (see FIGS. 3A and 4A). A first electric wire 91 having one end connected to the first device 80 is connected to the first electric wire connecting portion 85*a*. A first portion 97*a* and a coupling portion 97*b* described later of the circuit configuration portion 97 are connected to the first electric wire connecting portion 85*a*. A second electric wire 92 having one end connected to the second device 90 is connected to the second electric wire connecting portion 85*b*. The coupling portion 97*b* and a second portion 97*c* described later of the circuit configuration portion 97 are connected to the second electric wire connecting portion 85*b*. Note that if there are three or more safety devices, the number of electric wire connecting portions may be increased according to the number of safety devices.

(2-1-5-2) Circuit Configuration Portion

The circuit configuration portion 97 is an electric circuit connecting the connecting portion 85 to the utilization unit control device 44. The circuit configuration portion 97 constitutes the interlock circuit 98 together with the first electric wire 91 and the second electric wire 92. The circuit configuration portion 97 includes the first portion 97*a*, the coupling portion 97*b*, and the second portion 97*c*, as show in FIGS. 3A and 4A. The first portion 97*a* electrically connects the first electric wire connecting portion 85*a* to the utilization unit control device 44. The coupling portion 97*b* electrically connects the first electric wire connecting portion 85*a* to the second electric wire connecting portion 85*b*. The second portion 97*c* electrically connects the second electric wire connecting portion 85*b* to the utilization unit control device 44.

When the first electric wire 91 is connected to the first electric wire connecting portion 85*a*, the second electric wire 92 is connected to the second electric wire connecting portion 85*b*, and power is supplied to the first device 80 and the second device 90, a current flows through the interlock circuit 98 in the order of the first portion 97*a*, the first electric wire 91 (part of reference sign 91*a* in FIGS. 3A and 4A), the circuit configuration portion in the first device 80, the first electric wire 91 (part of reference sign 91*b*), the coupling portion 97*b*, the second electric wire 92 (part of reference sign 92*a*), the circuit configuration portion in the second device 90, the second electric wire 92 (part of reference sign 92*b*), and the second portion 97*c*.

(2-1-5-3) Mounting Portion

The mounting portion 25 is a portion to which the first member 110 that can form the first circuit 99 without going through the first electric wire 91 and the second electric wire 92 is attached.

As one example, as shown in FIG. 3A, the mode in which the first member 110 is mounted in the mounting portion 25 when the interlock function is used will be described. The mounting portion 25 includes a contact connected to the first portion 97*a* of the circuit configuration portion 97 and a contact connected to the second portion 97*c* of the circuit configuration portion 97. For example, the contact connected to the first portion 97*a* is pressed toward the contact connected to the second portion 97*c*. Part of the first member 110 is disposed between the contact connected to the first portion 97*a* and the contact connected to the second portion 97*c* when using the interlock function. Note that the first member 110 is preferably a single member integrally formed in order to improve workability during removal. The first member 110 here is made of, for example, an insulating material.

Therefore, when the first member 110 exists between the contact connected to the first portion 97*a* and the contact connected to the second portion 97*c*, no current flows between the contact connected to the first portion 97*a* and the contact connected to the second portion 97*c*. When releasing the interlock function, by pulling out the first member 110, the contact connected to the first portion 97*a* and the contact connected to the second portion 97*c* come into contact with each other, and the first circuit 99 different from the interlock circuit 98 is formed. The first circuit 99 is a circuit formed by short-circuiting the first portion 97*a* of the circuit configuration portion 97 and the second portion 97*c* of the circuit configuration portion 97. When a current flows through the first circuit 99, a current flows between the first portion 97*a* and the second portion 97*c* of the circuit configuration portion 97 as is the case where the interlock circuit 98 exists. Therefore, the utilization unit control device 44 permits the operation of the air conditioning apparatus 1.

Next, as another example, a specific example of the mode will be described in which the first member 110 is not mounted in the mounting portion 25 when using the interlock function, as shown in FIG. 4A. The first member 110 here is, for example, a jumper cable or a short-circuit connector inserted into the mounting portion 25. The mounting portion 25 includes a connecting portion connected to the first portion 97*a* of the circuit configuration portion 97 and a connecting portion connected to the second portion 97*c* of the circuit configuration portion 97. The connecting portion connected to the first portion 97*a* of the circuit configuration portion 97 and the connecting portion connected to the second portion 97*c* of the circuit configuration portion 97 are not connected and are disposed apart from each other. When using the interlock function, the first member 110 is not attached to the mounting portion 25. Therefore, no current flows between the connecting portion connected to the first portion 97*a* of the circuit configuration portion 97 and the connecting portion connected to the second portion 97*c* of the circuit configuration portion 97. When releasing the interlock function, by connecting the connecting portion connected to the first portion 97*a* of the circuit configuration portion 97 and the connecting portion connected to the second portion 97*c* of the circuit configuration portion 97 by using the conductive first member 110, the first circuit 99 different from the interlock circuit 98 is formed. The first circuit 99 is a circuit formed by short-circuiting the first portion 97*a* of the circuit configuration portion 97 and the second portion 97*c* of the circuit configuration portion 97. When a current flows through the first circuit 99, a current flows between the first portion 97*a* and the second portion 97*c* of the circuit configuration portion 97 as is the case where the interlock circuit 98 exists. Therefore, the utilization unit control device 44 permits the operation of the air conditioning apparatus 1.

(2-2) Safety Device

The air conditioning system 100 includes at least two types of safety devices as a measure against refrigerant leakage. As safety devices, the air conditioning system 100 of the present embodiment includes four types of safety devices (alarm device 70, ventilation device 60, isolation valve 50, refrigerant detector 34). The function of each safety device will be described later.

Note that when describing contents mainly related to the interlock function of the air conditioning apparatus 1 as described above, the air conditioning system 100 includes two types of devices, the first device 80 and the second device 90, as safety devices. In the above example, the first device 80 is the refrigerant detector 34, and the second device 90 is the alarm device 70, but are not limited to this example.

For example, the first device 80 is any one of the alarm device 70, the ventilation device 60, the isolation valve 50, and the refrigerant detector 34. The second device 90 is any one of the alarm device 70, the ventilation device 60, the isolation valve 50, and the refrigerant detector 34, and is a type of device different from the first device 80.

The number of safety devices included in the air conditioning system 100 is not limited to two. In addition to the first device 80 and the second device 90, as the third device, for example, the air conditioning system 100 may include any one device of the alarm device 70, the ventilation device 60, the isolation valve 50, and the refrigerant detector 34, the device having a different type from the first device 80 and the second device 90. In addition to the first device to the third device, as the fourth device, for example, the air conditioning system 100 may include any one device of the alarm device 70, the ventilation device 60, the isolation valve 50, and the refrigerant detector 34, the device having a different type from the first device to the third device.

The alarm device 70, the ventilation device 60, the isolation valve 50, and the refrigerant detector 34, which are safety devices, will be described below.

(2-2-1) Refrigerant Detector

The refrigerant detector 34 detects whether or not the refrigerant exists around the refrigerant detector 34. The refrigerant detector 34 is disposed in the casing of the utilization unit 3 (not shown) that houses the second expansion mechanism 31, the utilization heat exchanger 32, the second fan 33, and the like. The refrigerant detector 34 may be disposed outside the casing of the utilization unit 3.

The refrigerant detector 34 is, for example, a semiconductor sensor. The semiconductor refrigerant detector 34 includes a semiconductor detection element (not shown). The electric conductivity of the semiconductor detection element changes depending on whether or not the refrigerant gas exists nearby. As a result of having such a configuration, the refrigerant detector 34 outputs a relatively large current when the refrigerant gas exists around the semiconductor detection element.

Note that the refrigerant detector 34 is not limited to the semiconductor type, but is required at least to be a sensor that can detect refrigerant gas. For example, the refrigerant detector 34 may be an infrared sensor.

The signal detected by the refrigerant detector 34 is transmitted to the utilization unit control device 44 via the signal line 95. The utilization unit control device 44 determines refrigerant leakage according to the magnitude of the current of the signal output from the refrigerant detector 34.

(2-2-2) Alarm Device

The alarm device 70 is a safety device to notify refrigerant leakage when the refrigerant detector 34 detects the refrigerant leakage. Specifically, the alarm device 70 notifies the refrigerant leakage in response to the signal transmitted from the utilization unit control device 44 via the signal line 96.

The alarm device 70 includes a lamp 74 for notifying the refrigerant leakage and a speaker 76 for notifying the refrigerant leakage.

A control device 72 of the alarm device 70 controls the operation of the lamp 74 and the speaker 76. On receipt of the signal for causing the alarm device 70 to execute the notification operation of the refrigerant leakage, the signal being transmitted by the safety device control unit 45 of the utilization unit control device 44 via the signal line 96, the control device 72 turns on the lamp 74 and outputs an alarm sound from the speaker 76.

(2-2-3) Ventilation Device

The ventilation device 60 mainly includes a ventilation fan 64. A control device 62 of the ventilation device 60 controls the operation of the ventilation fan 64.

The ventilation fan 64 is a fan to discharge air in a space where the refrigerant possibly leaks from the space. For example, the ventilation fan 64 is a fan to discharge air in the space where the utilization unit 3 in which the refrigerant detector 34 is disposed is installed from the space.

The ventilation device 60 operates when the refrigerant detector 34 detects refrigerant leakage. Specifically, the control device 62 starts the operation of the ventilation fan 64 in response to the signal for activating the ventilation fan 64, the signal being transmitted by the safety device control unit 45 of the utilization unit control device 44 via the signal line 96.

(2-2-4) Isolation Valve

The isolation valve 50 includes the first isolation valve 54 provided in the liquid refrigerant connection pipe 4 and the second isolation valve 56 provided in the gas refrigerant connection pipe 5. The first isolation valve 54 and the second isolation valve 56 are, but are not limited to, electromagnetic valves or motor operated valves, for example. A control device 52 controls the operation of the first isolation valve 54 and the second isolation valve 56. Normally, the first isolation valve 54 and the second isolation valve 56 are in the open state. The isolation valve 50 closes the first isolation valve 54 and the second isolation valve 56 when the refrigerant detector 34 detects refrigerant leakage. Specifically, the control device 52 closes the first isolation valve 54 and the second isolation valve 56 in response to the signal for closing the first isolation valve 54 and the second isolation valve 56, the signal being transmitted by the safety device control unit 45 of the utilization unit control device 44 via the signal line 96.

(3) Features (3-1)

The air conditioning apparatus 1 according to the present embodiment is an air conditioning apparatus including the refrigerant circuit 6, and includes the connecting portion 85, the circuit configuration portion 97, the first member 110, and the control unit 22. To the connecting portion 85: the first electric wire 91 connected to the first device 80 of a plurality of safety devices including at least two types of the refrigerant detector, the alarm device, the isolation valve, and the ventilation device; and the second electric wire 92 connected to the second device 90 of a type different from the first device 80 of the plurality of safety devices are connected. The circuit configuration portion 97 forms the interlock circuit 98 together with the first electric wire 91 and the second electric wire 92 connected to the connecting portion 85. The first member 110 can form the first circuit 99 including at least part of the circuit configuration portion 97 without going through the first electric wire 91 and the second electric w % ire 92. The control unit 22 prohibits the operation of the air conditioning apparatus 1 when no current flows through either the interlock circuit 98 or the first circuit 99.

In the air conditioning apparatus 1 of the present embodiment, since the first member 110 can be used to form the first circuit 99 that can release the interlock of the air conditioning apparatus 1, it is not necessary to release the interlock for each of the plurality of safety devices when the safety devices are not used, providing good workability.

(3-2)

The first circuit 99 of the air conditioning apparatus 1 of the present embodiment is a circuit formed by short-circuiting the first portion 97*a* of the circuit configuration portion 97 and the second portion 97*c* of the circuit configuration portion 97.

The air conditioning apparatus 1 of the present embodiment can easily release the interlock with a plurality of safety devices at the same time by short-circuiting the circuit configuration portion 97 by using the first member 110.

(3-3)

The air conditioning apparatus 1 of the present embodiment includes the mounting portion 25 to which the first member 110 can be attached and detached. The first circuit 99 is formed by removing the first member 110 from the mounting portion 25.

In the air conditioning apparatus 1 of the present embodiment, the first circuit 99 can be formed by removing the first member 110, and the interlock with a plurality of safety devices can be quickly released. Since the first member 110 is normally attached to the mounting portion 25 when the air conditioning apparatus 1 is installed, the possibility of loss of the first member 110 can be reduced.

Instead, in the air conditioning apparatus 1, the first circuit 99 may be formed by attaching the first member 110 to the mounting portion 25. In such an air conditioning apparatus 1, the first circuit 99 can be formed by attaching the first member 110, and the interlock with a plurality of safety devices can be quickly released.

(4) Modifications

Next, modifications of the air conditioning apparatus 1 according to the present embodiment will be described. Note that constituent elements similar to those described in the embodiment are denoted with similar reference signs, and the detailed description thereof will be omitted.

(4-1) Modification A

In the above embodiment, the display unit 48*c* of the remote controller 48 notifies that the operation of the utilization unit 3 or the heat source unit 2 is prohibited. However, this is not restrictive.

The air conditioning system 100 may notify a mobile terminal or the like owned by an administrator of the air conditioning system 100 or the like via a communication line such as the Internet that the operation of at least one of the utilization unit 3 and the heat source unit 2 is prohibited.

The air conditioning system 100 may include, as a notification unit, an LED lamp disposed on the casing of the utilization unit 3 for notifying that the operation of the heat source unit 2 is prohibited.

(4-2) Modification B

For example, the alarm device 70 may include only one of the lamp 74 and the speaker 76 as means for making a notification of refrigerant leakage. The alarm device 70 may include another means for making a notification of refrigerant leakage, for example a vibration device, other than the lamp 74 and the speaker 76.

The lamp 74 and the speaker 76 of the alarm device 70 for notifying refrigerant leakage may be provided in the remote controller 48 or the utilization unit 3.

(4-3) Modification C

Figure 6:
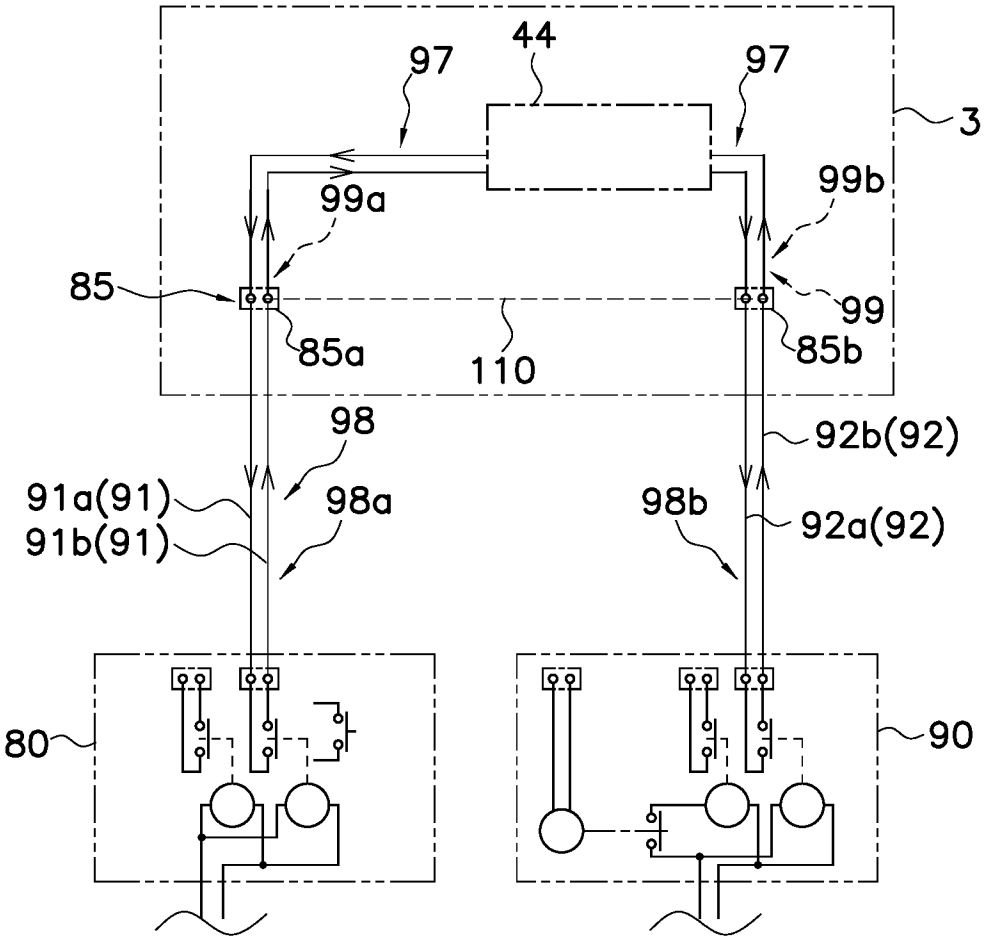
FIG. 6 is a schematic electrical circuit diagram for describing the interlock circuit and the first circuit of the air conditioning apparatus of a modification D.

In the above embodiment, the interlock circuit 98 is a circuit in which the utilization unit control device 44, the first device 80, and the second device 90 are connected in series by the first electric wire 91 and the second electric wire 92. However, this is not restrictive. As shown in FIG. 6, for example, the interlock circuit 98 may include a first interlock circuit 98*a* and a second interlock circuit 98*b* that are independent of each other.

In the first interlock circuit 98*a*, the utilization unit control device 44 is connected to the first electric wire connecting portion 85*a* via the circuit configuration portion 97, and the first electric wire connecting portion 85*a* is connected to the first device 80 via the first electric wire 91. In the second interlock circuit 98*b*, the utilization unit control device 44 is connected to the second electric wire connecting portion 85*b* via the circuit configuration portion 97, and the second electric wire connecting portion 85*b* is connected to the second device 90 via the second electric wire 92.

When using the interlock function, the utilization unit control device 44 in the example of FIG. 6 prohibits the operation of the air conditioning apparatus 1 when no current flows through at least one of the first interlock circuit 98*a* and the second interlock circuit 98*b*. In other words, the utilization unit control device 44 permits the operation of the air conditioning apparatus 1 when a current flows through both the first interlock circuit 98*a* and the second interlock circuit 98*b*.

In this way, when the interlock circuit 98 includes the first interlock circuit 98*a* and the second interlock circuit 98*b* that are independent of each other, the first member 110 is required at least, for example, to be a member that short-circuits all of the connecting portion of the first electric wire 91 for the first electric wire connecting portion 85*a*, and the connecting portion of the second electric wire 92 for the second electric wire connecting portion 85*b*. The first circuit 99 formed as a result includes two circuits (first circuit A 99*a* and first circuit B 99*b*). When the first member 110 is mounted in the connecting portion 85 serving as the mounting portion and a current flows through both the first circuit A 99*a* and the first circuit B 99*b*, the utilization unit control device 44 permits the operation of the air conditioning apparatus 1.

SUPPLEMENTARY NOTE

The embodiment of the present disclosure has been described above. It will be understood that various changes to modes and details can be made without departing from the spirit and scope of the present disclosure recited in the claims.

REFERENCE SIGNS LIST

1: air conditioning apparatus
6: refrigerant circuit
22: control unit
25: mounting portion
80: first device
85: connecting portion
90: second device
91: first electric wire
92: second electric wire
97: circuit configuration portion
97*a*: first portion
97*c*: second portion
98: interlock circuit
98*a*: first interlock circuit (interlock circuit)
98*b*: second interlock circuit (interlock circuit)
99: first circuit
99*a*: first circuit A (first circuit)
99*b*: first circuit B (first circuit)
110: first member

CITATION LIST

Patent Literature

Patent Literature 1: JP 2019-52785 A

The invention claimed is:

1. An air conditioning apparatus including a refrigerant circuit, the air conditioning apparatus comprising:

a connecting portion to which: a first electric wire and a second electric wire are connected, the first electric wire being connected to a first device of a plurality of safety devices, and the second electric wire being connected to a second device of the plurality of safety devices in which the second device is a type different from the first device, the plurality of safety devices including at least two types of a refrigerant detector, an alarm device, an isolation valve, and a ventilator;

a circuit configuration portion forming an interlock circuit together with the first electric wire and the second electric wire connected to the connecting portion;

a first member that enables formation of a first circuit via a short circuit, the first circuit including at least part of the circuit configuration portion and not including both the first electric wire and the second electric wire; and a controller that prohibits an operation of the air conditioning apparatus when no current flows through either the interlock circuit or the first circuit.

2. The air conditioning apparatus according to claim 1, wherein the first circuit is a circuit formed by short-circuiting a first portion of the circuit configuration portion and a second portion of the circuit configuration portion.

3. The air conditioning apparatus according to claim 1, further comprising a mounting portion to which the first member is attachable and detachable, wherein the first circuit is formed by removing the first member from the mounting portion.

4. The air conditioning apparatus according to claim 1, further comprising a mounting portion to which the first member is attachable and detachable, wherein the first circuit is formed by attaching the first member to the mounting portion.

5. The air conditioning apparatus according to claim 2, further comprising a mounting portion to which the first member is attachable and detachable, wherein the first circuit is formed by removing the first member from the mounting portion.

6. The air conditioning apparatus according to claim 2, further comprising a mounting portion to which the first member is attachable and detachable, wherein the first circuit is formed by attaching the first member to the mounting portion.

* * * * *